United States Patent [19]

Kaneko et al.

[11] Patent Number: 4,829,495

[45] Date of Patent: May 9, 1989

[54] PENDULUM DEVICE FOR CLOCKS

[75] Inventors: Kouichi Kaneko; Tsutomu Matsuzaki, both of Tokyo, Japan

[73] Assignee: Seikosha Co., Ltd., Tokyo, Japan

[21] Appl. No.: 167,345

[22] Filed: Mar. 14, 1988

[30] Foreign Application Priority Data

Mar. 18, 1987 [JP] Japan ..... 62-39567
Sep. 30, 1987 [JP] Japan ..... 62-150293

[51] Int. Cl.[4] ..... G04B 17/02

[52] U.S. Cl. ..... 368/134; 368/165; 368/179

[58] Field of Search ..... 368/134, 167, 165, 179, 368/181

[56] References Cited

U.S. PATENT DOCUMENTS 4,228,533 10/1980 Siefert ..... 368/134
4,613,236 9/1986 Nakamura ..... 368/165

*Primary Examiner*—Bernard Roskoski
*Attorney, Agent, or Firm*—Bruce L. Adams; Van C. Wilks

[57] ABSTRACT

A pendulum rod is mounted so as to be able to swing within a desired or a normal swing angle. The means mounting the pendulum rod include means for restricting movement of the pendulum rod along the swinging axis relative to the support body when the pendulum rod is within this desired swinging angle to prevent the detachment thereof and for enabling free movement of the pendulum rod along the swinging axis when the pendulum exceeds the desired swinging angle to permit detachment thereof. The mounting means also include means for restricting upward movement of the pendulum along longitudinal axis and relative to the support body to prevent detachment thereof. These desired functions are carried out by one of the swinging center body and support being provided with a pair of v-shaped projections positioned at a desired interval and the other of the center body and the support portion have a pair of v-shaped grooves which engage the projections and the restricting portion which is loosely fitted between the projections and restricts the longitudinal movement of the swinging body.

7 Claims, 4 Drawing Sheets

PENDULUM DEVICE FOR CLOCKS

BACKGROUND OF THE INVENTION

This invention relates to a pendulum device for use in a clock or the like.

A variety of pendulum devices are known, for example, one known device is disclosed in Japanese Utility Model Publication No. 19280/1983, in which a horizontal guide groove is formed in a pendulum support portion disposed in a frame which holds a clock movement. A cover portion is provided above the guide groove. A pair of V-shaped projections are formed on an upper surface of the support body which slides in the guide groove detachably. A rotational center body which is disposed at the top end of a pendulum rod is put on the V-shaped projections through V-shaped grooves which are provided at the two ends of the rotational center body. Then the support body is inserted into the guide groove, whereby the pendulum rod is mounted.

However, in the above described conventional pendulum device, a large number of parts is needed, and the manufacturing cost thus becomes large. Furtheremore, mounting of the pendulum rod is a very complicated task.

SUMMARY OF THE INVENTION

An object of the present invention, therefore, is to reduce the number of parts and allow a pendulum rod to be mounted easily, as well as to reduce manufacturing costs.

A pendulum device according to the present comprises:

- a pendulum rod having at the top thereof a swinging center body which extends horizontally;
- a support body having a support portion for rockably supporting said swinging center body;
- one of said swinging center body and said support portion being provided with a pair of V-shaped projections positioned at a desired interval;
- the other of said swinging center body and said support portion being provided with a pair of V-shaped grooves engageable with said projections and a restricting portion fitting loosely between said projections so as to restrict the longitudinal position of said swinging center body;
- said restricting portion being provided with a guide groove which connects to said V-shaped grooves and which allows said projections to pass when said pendulum rod was swung to an extent that exceeds a normal swinging angle; and
- at least one of said pendulum rod and said support body being provided with restricting means for restricting said pendulum rod from detaching upwardly.

BRIEF DESCRIPTION OF THE DRAWINGS

Accompanying drawings illustrate an embodiment of the present invention model, wherein.

DETAILED DESCRIPTION OF THE INVENTION

Referring to the accompanying drawings, an embodiment according to the present utility model will now be described.

Figure 1:
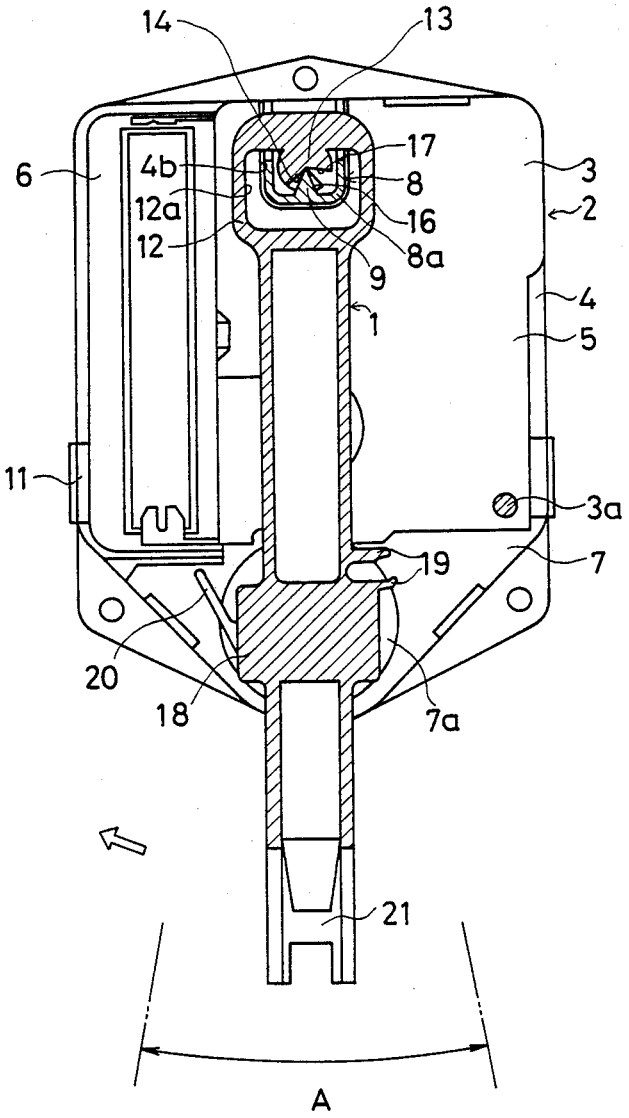
FIG. 1 is a rear cross-sectional view of a pendulum device.

FIG. 1 shows the back of the pendulum device which is an essential portion of this invention. A movement case 2 which serves as a support body of the pendulum rod 1 comprises an upper case 3 and a lower case 4. In this case 2 is provided a timepiece mechanism accommodating portion 5 in which a timepiece mechanism (not shown) is accomodated. A battery accommodating chamber 6 is provided in the side portion of the timepiece mechanism accommodating portion 5. A driving circuit accommodating portion 7 for accommodating a driving circuit (not shown) which is driven to swing the pendulum rod 1 is provided in a lower portion of the case 2. The central portion of the driving circuit accommodating portion 7 is provided with an exciting coil accommodating portion 7*a* for accommodating an exciting coil (not shown). Reference numeral 3*a* represents a fastening pin for securing the pendulum rod 1 in such a manner that it cannot be swung when being transported.

Figure 2:
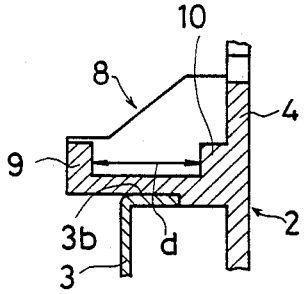
FIG. 2 is a cross-sectional view of a support portion.
Figure 3:
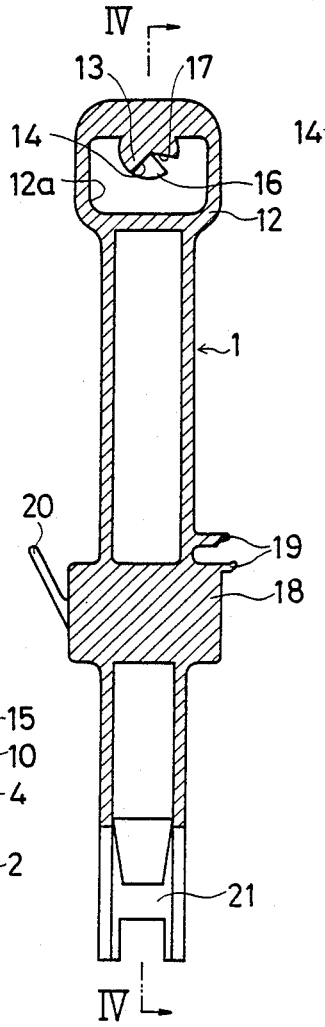
FIG. 3 is a partial front cross-sectional view of a pendulum rod.
Figure 4:
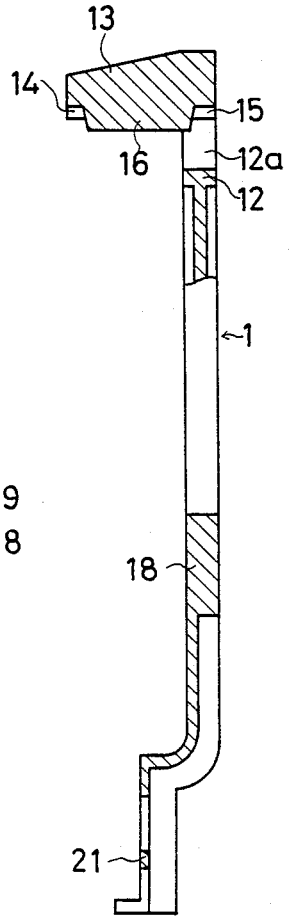
FIG. 4 is a cross-sectional view taken along the line IV—IV of FIG. 3.
Figure 5:
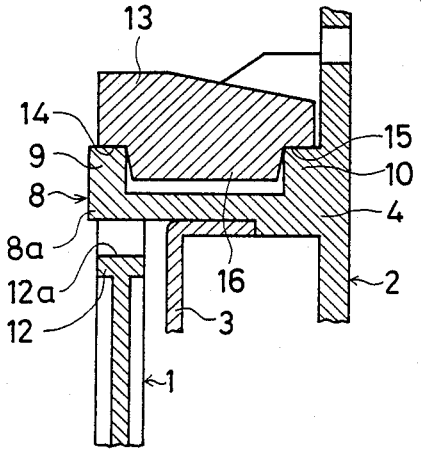
FIG. 5 is an enlarged view illustrating a state in which a pendulum rod is attached.

A support portion 8 for supporting the pendulum rod 1 in such a manner that it can swing rockably is provided at the top end of the timepiece movement case 2. As shown in FIG. 2, the support portion 8 is integrally formed with the lower case 4, and has a projected portion which projects over the upper case 3 through a U-shaped groove portion 3*b* formed in the upper portion of the upper case 3. V-shaped projections 9 and 10 are provided on the upper surface of the support portion 8 in such a manner that the projections are disposed away from each other with an interval d between them.

As shown in FIG. 1, a stationary member 11 is provided in the side portion of the battery case 6. The stationary member 11 is integrally formed with the support body 2, projects over the support body 2, and is so positioned that the pendulum rod 1 comes into contact with it.

Figure 6:
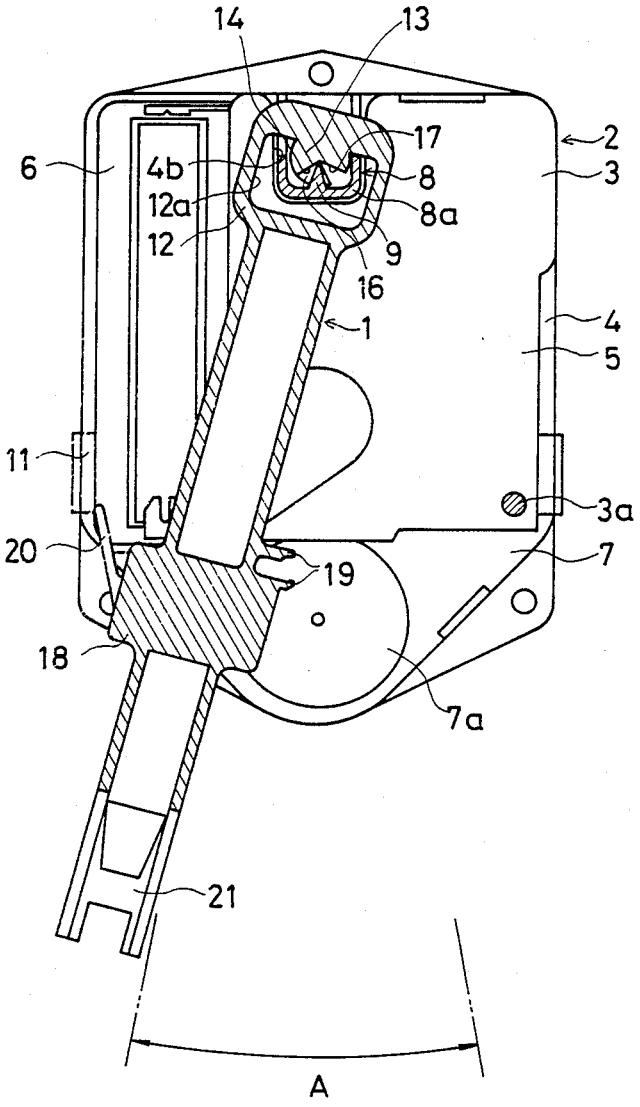
FIG. 6 is a partial rear cross-sectional view illustrating a state in which an elastic arm is positioned in contact with a stationary member.

As shown in FIG. 1 and FIGS. 3 to 7, a frame 12 in which an opening 12*a* is formed is formed integrally with the top of end of the pendulum rod 1. A swinging center body 13 which extends horizontally along the opening 12*a* is provided at the upper end portion of the frame 12. V-shaped groove portions 14 and 15 which respectively engage with the projections 9 and 10 are provided at the two ends of the swinging center body 13. A restricting portion 16 which is fitting loosely in the interval d between the projections 9 and 10 is also provided for the swinging center body 13. The restricting portion 16 is provided with a guide groove 17 which connects to the groove portions 14 and 15 and which allows the projections 9 and 10 to pass when the pendulum rod 1 was swung in the direction shown by an arrow in FIG. 1, to an extent that exceeds a normal swinging angle A. The pendulum rod 1 is provided with a magnet holding portion 18 for holding a permanent magnet (not shown) at the position opposing the exciting coil accommodating portion 7a. A pair of securing hooks 19 for securing the pendulum rod 1, such as to prevent it from movement by being brought into engagement with the securing pin 3a when being transported, are provided above the magnet holding portion 18. An elastic arm 20 is provided in the side portion of the magnet holding portion 18. The elastic arm 20 is formed integrally with the pendulum rod 1, and its size and shape are such that it allows, as shown in FIG. 6, to engage with the securing member 11 when the pendulum rod 1 swings to an extent that exceeds a normal swinging angle. Reference numeral 21 represents a connecting portion for connecting the pendulum (not shown) to the pendulum rod 1.

Figure 7:
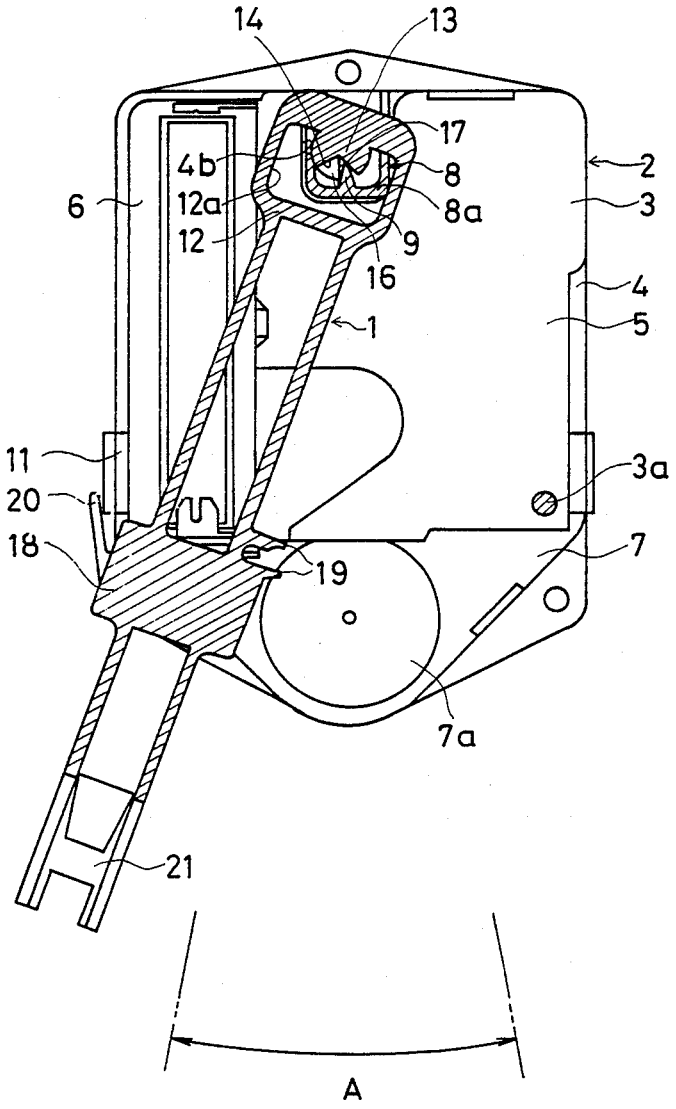
FIG. 7 is a partial back cross-sectional view illustrating a method of attaching a pendulum rod.

When the pendulum rod 1 is attached to the case 2, as shown in FIG. 7, the elastic arm 20 is first positioned outside the securing member 11. With this position kept for the purpose of allowing the V-shaped projections 9 and 10 provided on a top surface of the support portion 8 to pass the guide groove 17 formed in the restricting portion 16 of the swinging center body 13 which is disposed at the upper end of the pendulum rod 1, the swinging center body 13 is slides the projections 9 and 10 along the guide groove 17 from the rearside of the case 2 toward the front surface thereof. By positioning the pendulum rod 1 within a normal swinging angle A with the elastic arm 20 deformed elastically, the V-shaped groove portions 14 and 15 which are respectively provided for the two ends of the swinging center body 13 are, as shown in FIG. 6, engaged with the corresponding V-shaped projections 9 and 10 disposed on the upper surface of the support portion 8. As a result, the restricting portion 16 is fitted loosely into the interval d between the projections 9 and 10, whereby the pendulum rod 1 is suppoerted in such a manner that it can swing rockably with the longitudinal position of the swinging center body 13 restricted.

If the pendulum rod 1 swings in excess of the normal swinging angle, the elastic arm 11, as shown in FIG. 6, engages elastically with the stationary member. Therefore, the pendulum rod 1 is always positioned within the normal swinging angle A without any separation of the pendulum rod 1 from the support portion 8 beyond the restricting portion 16. Furthermore, when upward force is applied, the lower surface of the projecting portion 8a is brought into contact with the inner edge of the frame 12, consequently the projecting portion 8a and the frame 12 serve as a restricting means, whereby upwardly detachment of the pendulum rod 1 is restricted. Consequently, the pendulum rod 1 is supported by the support portion 8 in such a manner that it cannot be detached and can swing rockably within the normal swinging angle A. When the pendulum device is transported, the securing hooks 19 may be fastened to the securing pin 3a so as to secure the pendulum rod 1 to not move for the purpose of securing the pendulum rod 1 to the timepiece movement case 2 in such a manner that it cannot be separated, allowing transportation to be carried out smoothly.

In this embodiment, although the structure described is one in which the projecting positions 9 and 10 are provided in the support portion 8, and the groove portions 14 and 15 and the restricting portion 16 are provided in the swinging center body 13, the projecting portions 9 and 10 may be provided in the swinging center body 13, and the groove portions 14 and 15 and the restricting portion 16 may also be provided in the support portion 8. Although restricting means for restricting the pendulum rod 1 from detaching upwardly is formed by a projecting portion 8a projecting rearwards over the case 2 and a frame 12 formed in the upper end portion of the pendulum rod 1, the restricting means may be formed by a cover or the like opposing the upper surface of the swinging center body 13 and the cover or the like may be provided at the top end of the support portion 8. Although, the elastic arm 20 is provided on the pendulum rod 1, it may be provided on a stationary member such as the timepiece movement case 2 or a timepiece movement fixing plate (not shown).

As described above, the present invention has excellent the following advantages;

the number of parts can be reduced, whereby manufacturing cost can be reduced. Furthermore, attaching the pendulum rod can be very easily carried out and separation of the pendulum rod can be prevented.

What is claimed is:

1. A pendulum device comprising:

a pendulum rod having a top portion with a swinging center body which extends horizontally;

a support body having a support portion for rockably supporting said swinging center body to permit the pendulum rod to swing within a normal swinging angle;

wherein one of said swinging center body and said support portion has a pair of V-shaped projections positioned at a desired interval;

wherein the other of said swinging center body and said support portion has a pair of V-shaped grooves engageable with said projections and a restricting portion fitting loosely between said projections to restrict the longitudinal position of said swinging center body;

wherein said restricting portion has a guide groove which connects said V-shaped grooves and which allows said projections to pass when moved in a longitudinal direction when said pendulum rod is swung to an extent that exceeds said normal swinging angle; and wherein at least one of said pendulum rod and said support body has restricting means for restricting said pendulum rod from detaching upwardly.

2. A pendulum device according to claim 1, further comprising a stationary member which is stationary with respect to the support body and wherein one of said pendulum rod and stationary member has an elastic arm for elastically engaging with the other of said pendulum rod and said stationary member to restrict the free swinging angle of said pendulum rod to within said normal swinging angle.

3. A pendulum device comprising:

a pendulum rod having a longitudinal axis;

a support body; and means mounting the pendulum rod on the support body for swinging motion about a swinging axis disposed perpendicular to the longitudinal axis and within a desired swinging angle, wherein the mounting means comprises means for restricting movement of the pendulum rod along the swinging axis relative to the support body when the pendulum rod is within the desired swinging angle to prevent detachment thereof and for enabling free movement of the pendulum rod along the swinging axis when the pendulum rod exceeds the desired swinging angle to permit detachment thereof, and means for restricting upward movement of the pendulum rod along the longitudinal axis and relative to the support body to prevent detachment thereof.

4. The device according to claim 3, wherein the mounting means comprises a center body at the top portion of the pendulum rod, a support portion on the support body, wherein one of the center body and support portion has a pair of V-shaped projections spaced apart at a given distance, wherein the other of the center body and support portion has a pair of V-shaped grooves engageable with the projections, and wherein the means for restricting movement along the swinging axis comprises a restricting portion on said other of the center body and support portion disposed between the projections and a guide groove in the restricting portion which connects the V-shaped grooves and which is positioned to allow the projections to pass when the pendulum is swung beyond the desired swinging angle.

5. The device according to claim 4, further comprising a member on the support body which is stationary with respect thereto and wherein one of the stationary member and pendulum rod has an elastic arm thereon for engaging the other of the stationary member and pendulum rod to limit swing of the pendulum rod to within the desired swinging angle.

6. The device according to claim 5, wherein the guide groove is positioned to permit the projections to pass when the pendulum rod exceeds the desired swinging angle in only one direction.

7. The device according to claim 6, further comprising means disposed on the support body and the pendulum rod for retaining the pendulum rod in a position wherein it exceeds the desired swinging angle in the other direction.

* * * * *